US011498239B2

(12) United States Patent
Brown

(10) Patent No.: US 11,498,239 B2
(45) Date of Patent: Nov. 15, 2022

(54) ADJUSTABLE STOP FOR CUTTING WOOD AND PORTABLE TABLE ASSEMBLY

(71) Applicant: Kent L. Brown, Des Moines, IA (US)

(72) Inventor: Kent L. Brown, Des Moines, IA (US)

( * ) Notice: Subject to any disclaimer, the term of this patent is extended or adjusted under 35 U.S.C. 154(b) by 0 days.

(21) Appl. No.: 17/198,403

(22) Filed: Mar. 11, 2021

(65) Prior Publication Data

US 2021/0299906 A1 Sep. 30, 2021

Related U.S. Application Data

(63) Continuation-in-part of application No. 16/136,428, filed on Sep. 20, 2018, now abandoned.

(60) Provisional application No. 62/693,664, filed on Jul. 3, 2018, provisional application No. 62/648,656, filed on Mar. 27, 2018, provisional application No. 62/560,883, filed on Sep. 20, 2017.

(51) Int. Cl.
*B27B 27/10* (2006.01)

(52) U.S. Cl.
CPC ..... *B27B 27/10* (2013.01); *Y10T 83/7613* (2015.04)

(58) Field of Classification Search
CPC ... Y10T 83/7763; Y10T 83/727; Y10T 83/73; Y10T 83/7593; Y10T 83/7607; Y10T 83/7613; Y10T 83/7627; Y10T 83/7647; Y10T 83/76; Y10T 83/7633; Y10T 83/764; B27B 27/10; B27B 27/00; B27B 27/02; B27B 27/04; B27B 27/08
See application file for complete search history.

(56) References Cited

U.S. PATENT DOCUMENTS 2,525,894 A * 10/1950 Graham ..... B23Q 3/002 144/242.1
2,612,914 A * 10/1952 Reynolds ..... B23Q 3/002 144/250.18
4,188,754 A * 2/1980 Yamamoto ..... B24B 27/0608 83/485
4,969,380 A * 11/1990 Halligan ..... B27G 5/00 144/136.9
5,301,726 A * 4/1994 Wojcik ..... B23Q 3/002 144/250.18
2011/0303064 A1* 12/2011 Wang ..... B27B 27/08 83/440

* cited by examiner

*Primary Examiner* — Phong H Nguyen
(74) *Attorney, Agent, or Firm* — Zarley Law Firm P.L.C.

(57) ABSTRACT

An adjustable device for cutting an object has a frame with a back member that extends between a pair of feet. The feet are adjustably connected to a work bench or portable work table assembly. A spring biasing member has a back plate and a pair of side rods that extend from the back plate, through the back member, and are connected to a front member. A plurality of spacers are positioned between the front and back members.

20 Claims, 15 Drawing Sheets

ADJUSTABLE STOP FOR CUTTING WOOD AND PORTABLE TABLE ASSEMBLY

CROSS REFERENCE TO RELATED APPLICATIONS

This application is a continuation in part of U.S. application Ser. No. 16/136,428 filed Sep. 20, 2018, which claims the benefit of U.S. Provisional Application Nos. 62/560,883 filed Sep. 20, 2017, 62/648,656 filed Mar. 27, 2018 and 62/693,664 filed Jul. 3, 2018 the contents of these applications are hereby incorporated by reference in their entirety.

BACKGROUND OF THE INVENTION

This invention is directed to an adjustable stop and more particularly to an adjustable stop for cutting large quantities of wood in a uniform manner that is adjustable and repeatable. This invention is also directed to a portable table assembly for cutting an object.

The process of cutting wood is well-known in the art. Typically, one measures a piece of wood where a cut is to be made, the wood is then marked with a pencil or a pen, and then the piece of wood is cut. Such a process can be time consuming, particularly where a large quantity of boards need to be cut a uniform length. Table saws and radial arm saws are known in the art. Typically, these saws are mounted to a fixed bench or table in a workshop. While useful, because the tables are fixed, one is not able to bring the saws to a job site. Some saws are mounted to a bench that can be carried to a job site by several individuals. Still these mobile saws are difficult to move and have limited space for cutting objects. Accordingly, a need exists in the art for a device that addresses these deficiencies.

An object of the present invention is to provide an adjustable stop for cutting wood that provides a means of quickly cutting a large quantity of wood in a uniform and repeatable manner.

A further objective of the present invention is to provide an adjustable device for cutting wood that is operated by one person and the step of measuring each individual piece of wood eliminated.

A still further objective of the present invention is to provide a portable table assembly that is easy to move and has an expanded area for cutting objects.

These and other objectives will be apparent to those having ordinary skill in the art based upon the following written description, drawings and claims.

SUMMARY OF THE INVENTION

An adjustable device for cutting an object includes a frame having a back member that extends between a pair of feet. The feet are adjustably connected to a work bench or table. Connected to the frame is a spring biasing member. The spring biasing member includes a back plate and a pair of side rods that extend from the back plate, through the back member, and are connected to a front member. In one example, a pair of compression springs are fitted about the side rods between the back plate and the back member.

In another example, the spring biasing member has a cross member that extends between the pair of side rods. A hollow transverse member is connected to the cross member and extends from the cross member toward the back member A biasing member is connected to the back member and positioned to align with and be slidably received within the hollow transverse member. A compression spring is disposed about the biasing member. A plurality of spacers are selectively positioned between the front and the back member.

The adjustable device can be used with a portable table assembly. In one example the portable table assembly has a table saw assembly and an elongated table having a cut-out section that receives and is connected to a top wall of the table saw assembly. The elongated table is pivotally connected to a plurality of support members.

In another example, the portable table assembly has a radial arm saw mounted to a first table section that is supported by legs. A second table section is pivotally connected to the first table section at one end and a third table section at an opposite end. A support member is pivotally connected to the third table section adjacent the second table section.

DETAILED DESCRIPTION OF THE PREFERRED EMBODIMENTS

Figure 1:
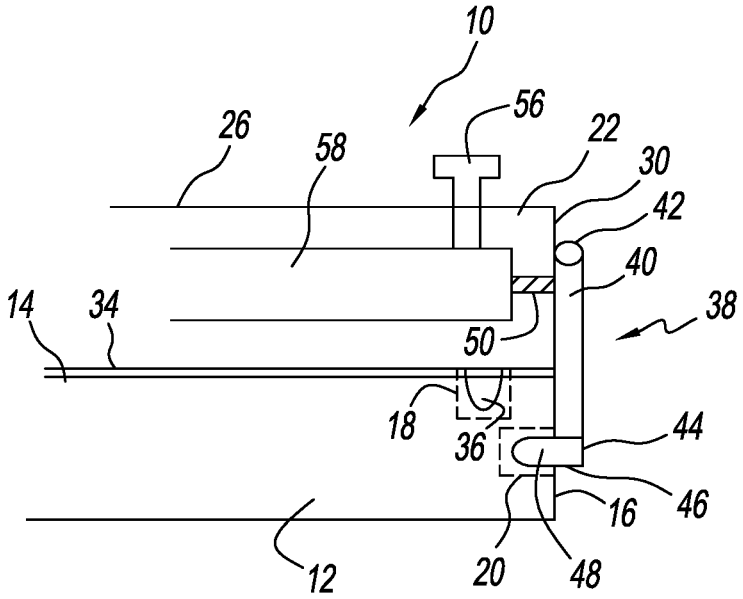
FIG. 1 is a side sectional view of an adjustable stop.
Figure 2:
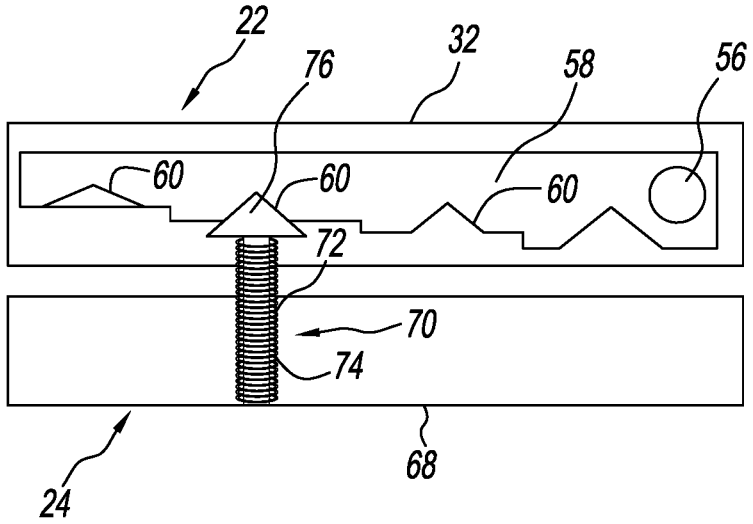
FIG. 2 is a front sectional view of an adjustable stop.
Figure 3:
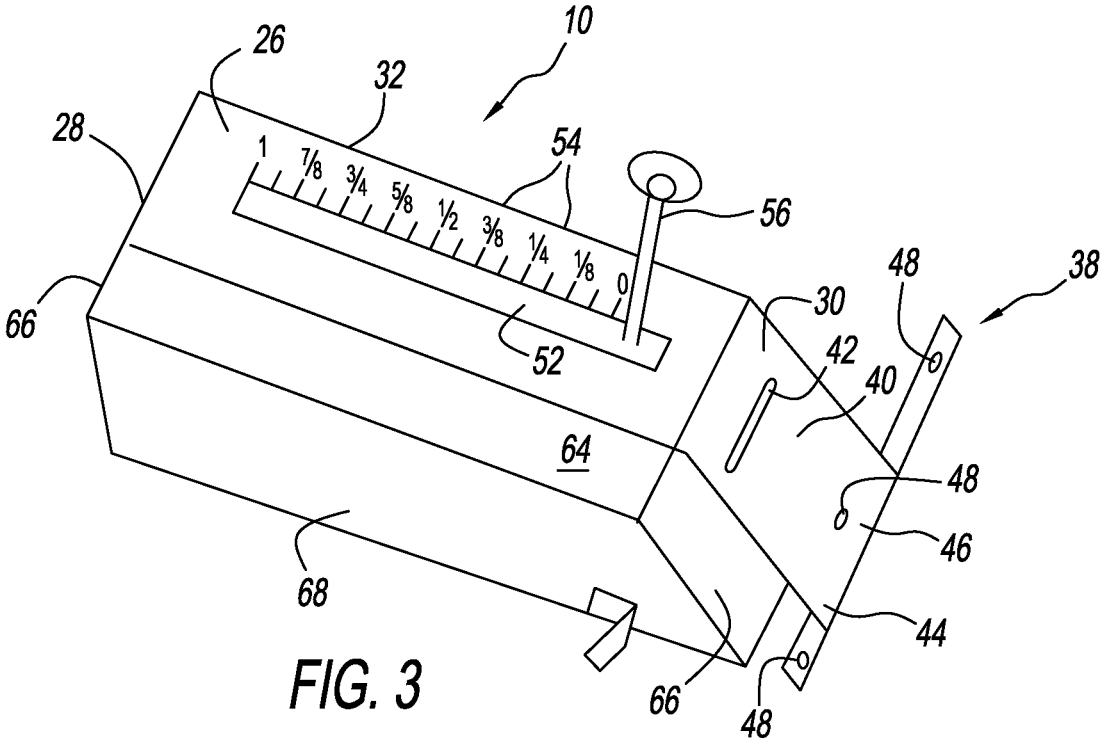
FIG. 3 is a top perspective view of an adjustable stop.
Figure 4:
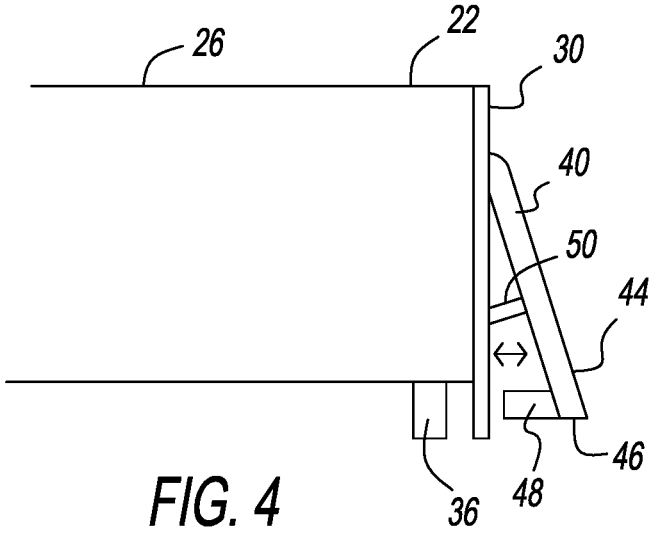
FIG. 4 is a side sectional view of an adjustable stop.
Figure 5:
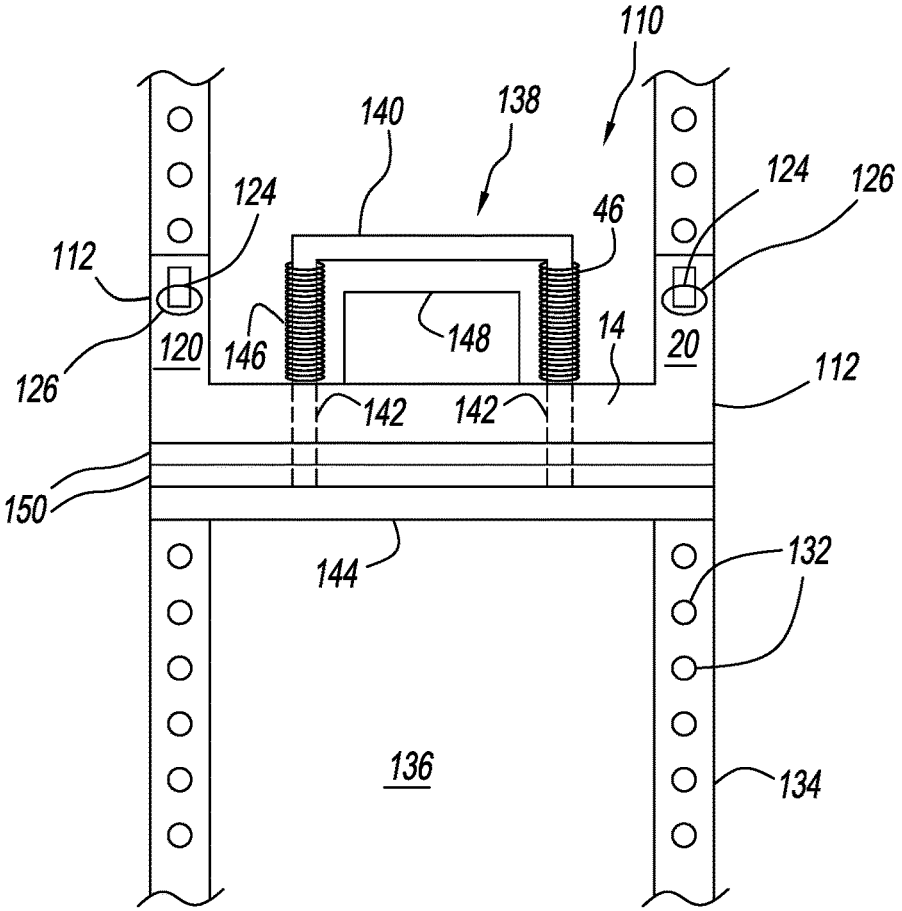
FIG. 5 is a top plan view of an adjustable device.
Figure 6:
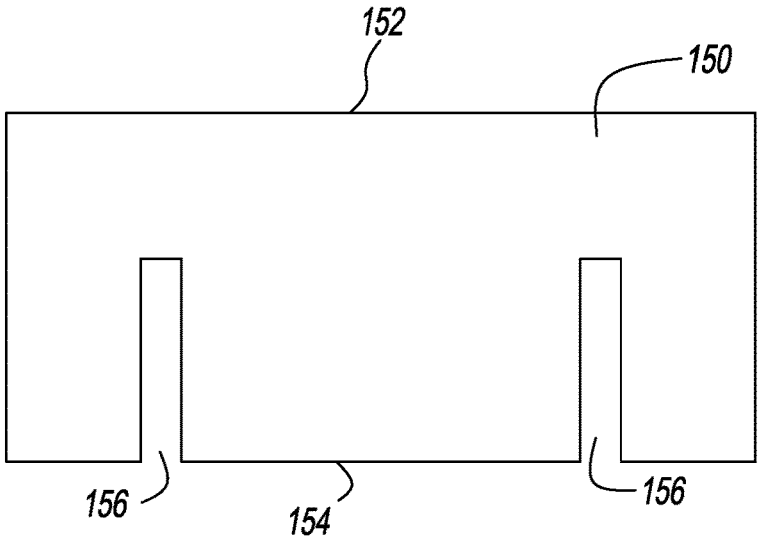
FIG. 6 is a front view of a spacer.
Figure 7:
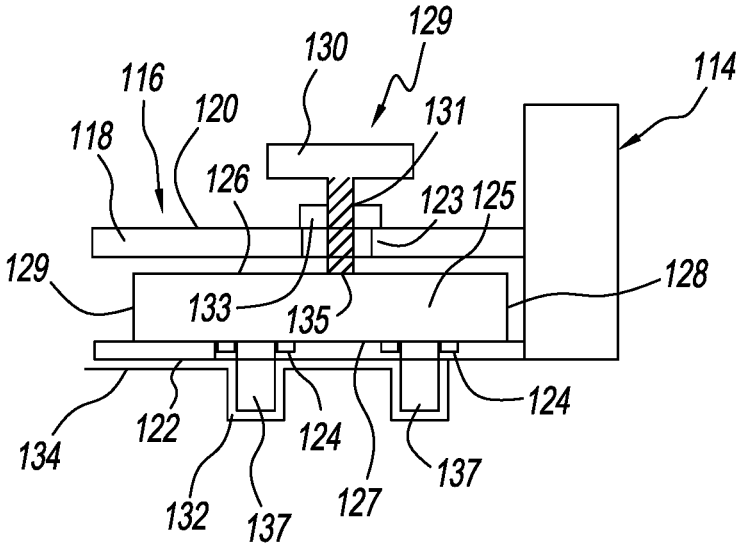
FIG. 7 is a side sectional view of an adjustable device.
Figure 8:
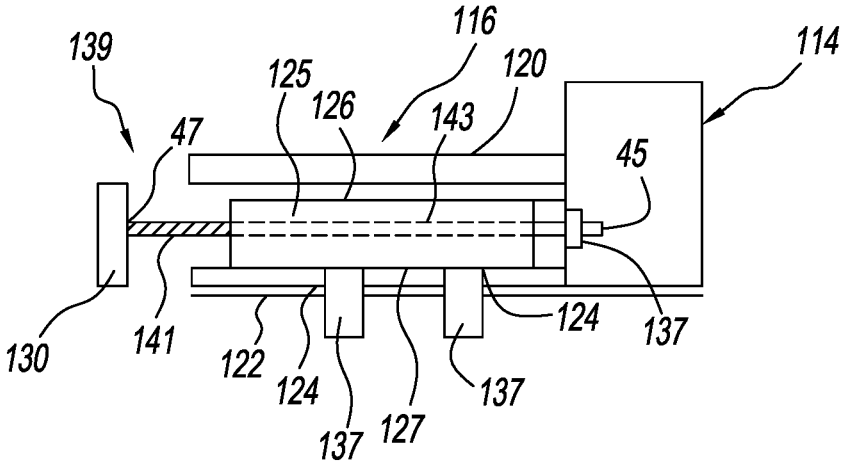
FIG. 8 is a side sectional view of an adjustable device.
Figure 9:
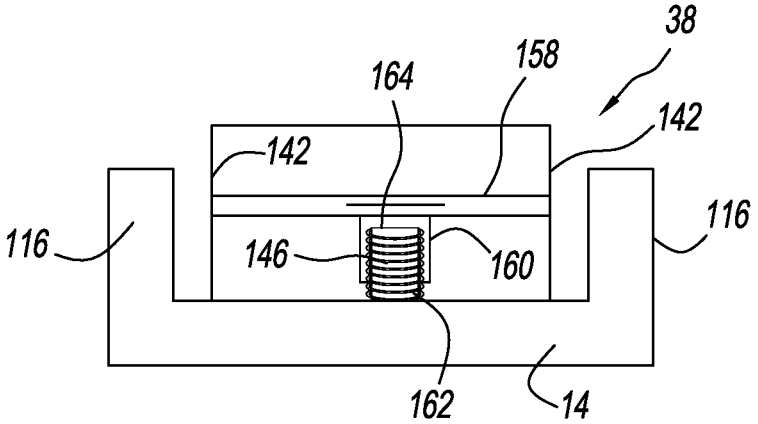
FIG. 9 is a top plan sectional view of an adjustable device.
Figure 10:
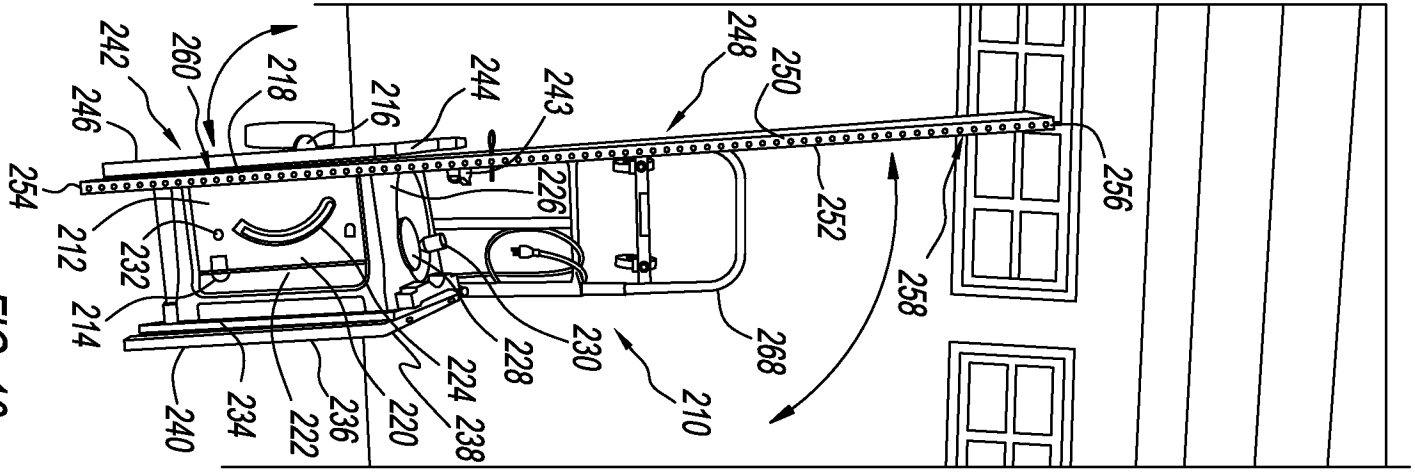
FIG. 10 is a perspective view of a portable table assembly.
Figure 11:
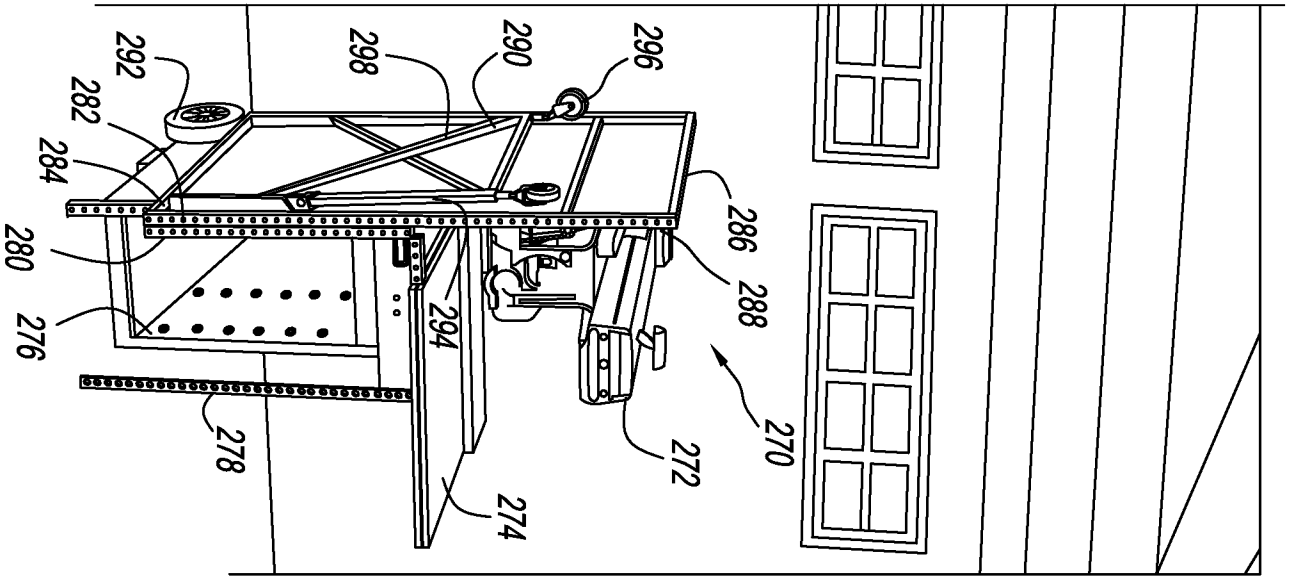
FIG. 11 is a perspective view of a portable table assembly.
Figure 12:
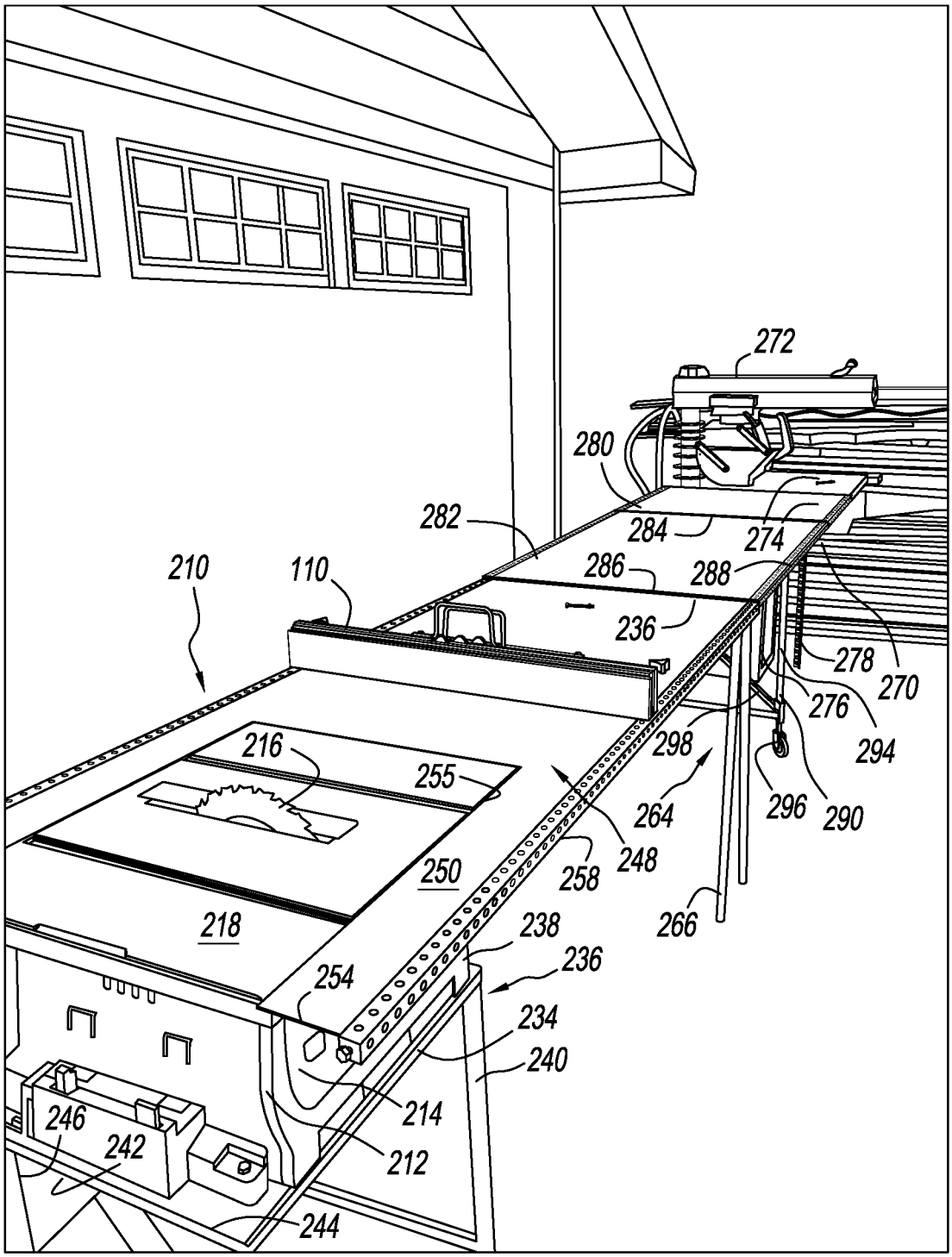
FIG. 12 is a top perspective view of a portable table assembly.
Figure 13:
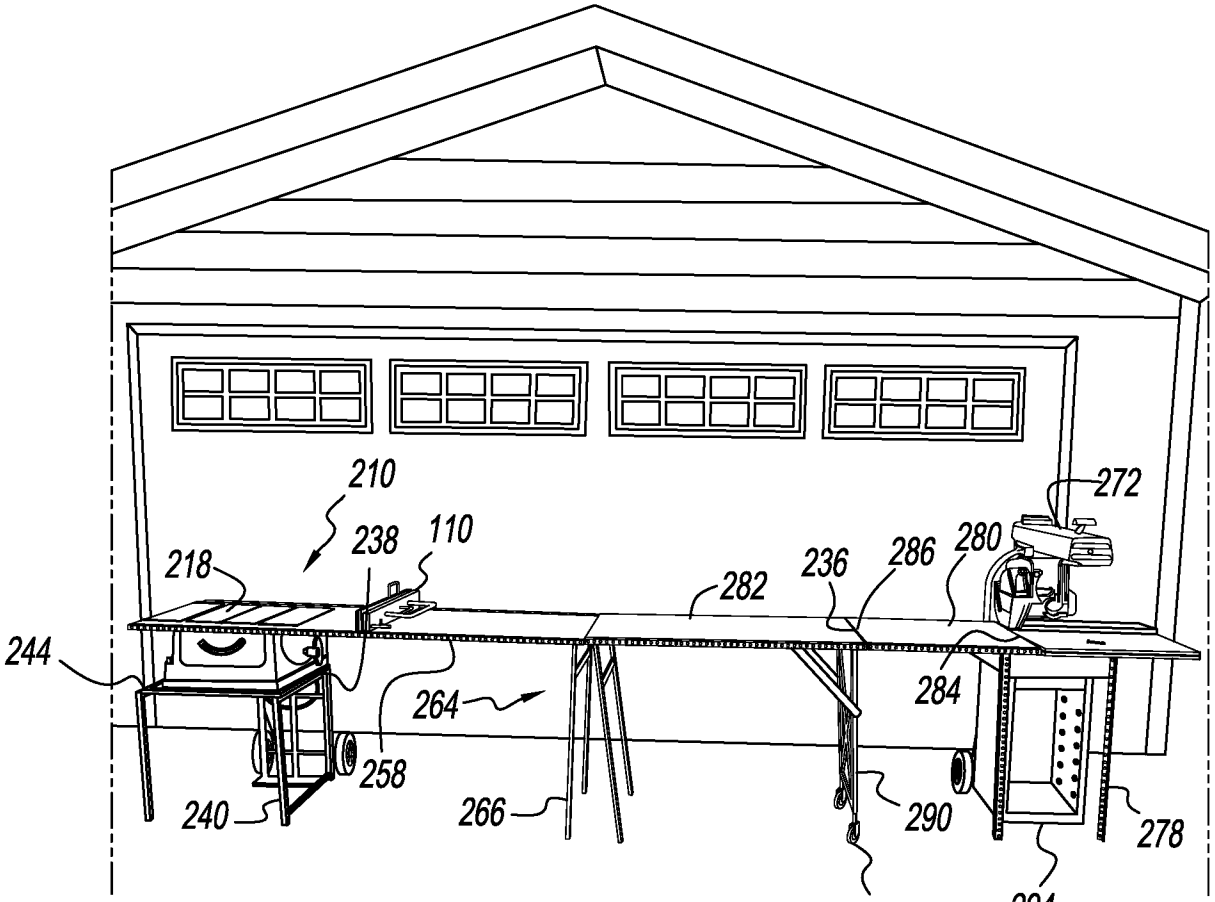
FIG. 13 is a side perspective view of a portable table assembly.
Figure 14:
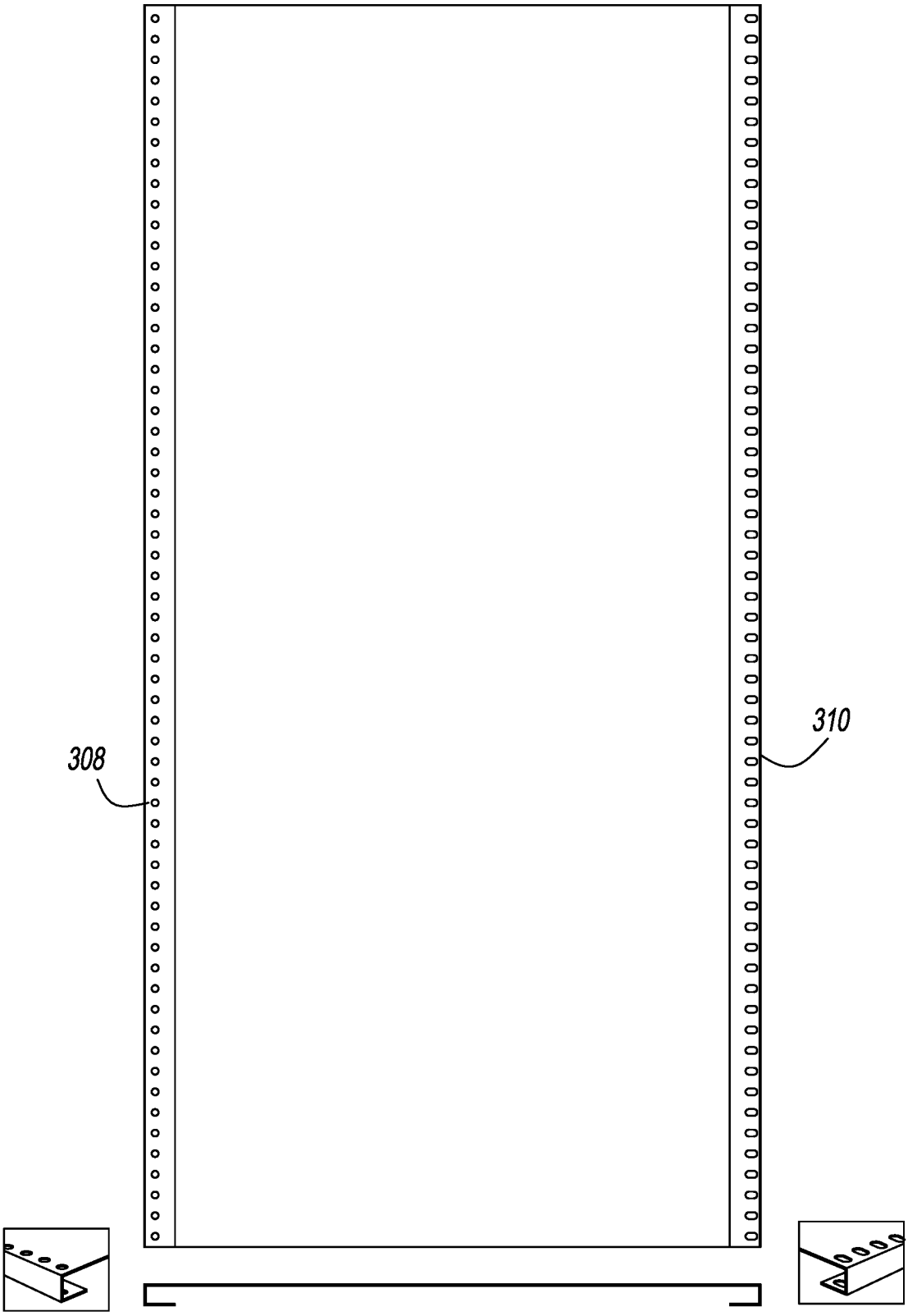
FIG. 14 is a top plan view of a portable table assembly.
Figure 15:
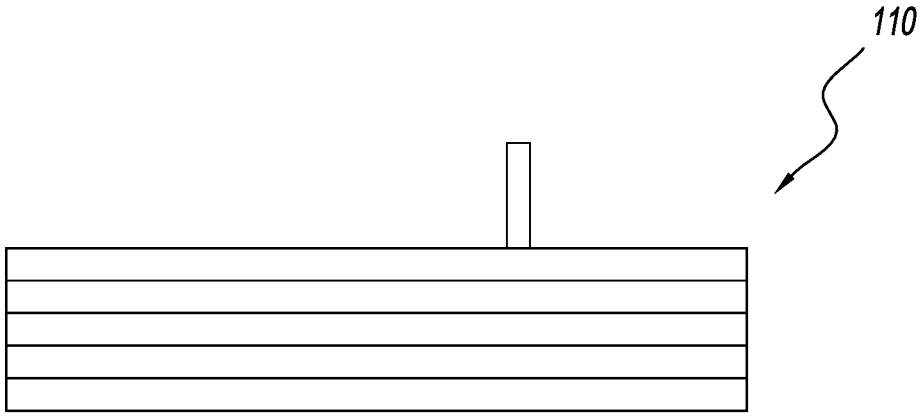
FIG. 15 is a top plan view of an adjustable device.
Figure 16:
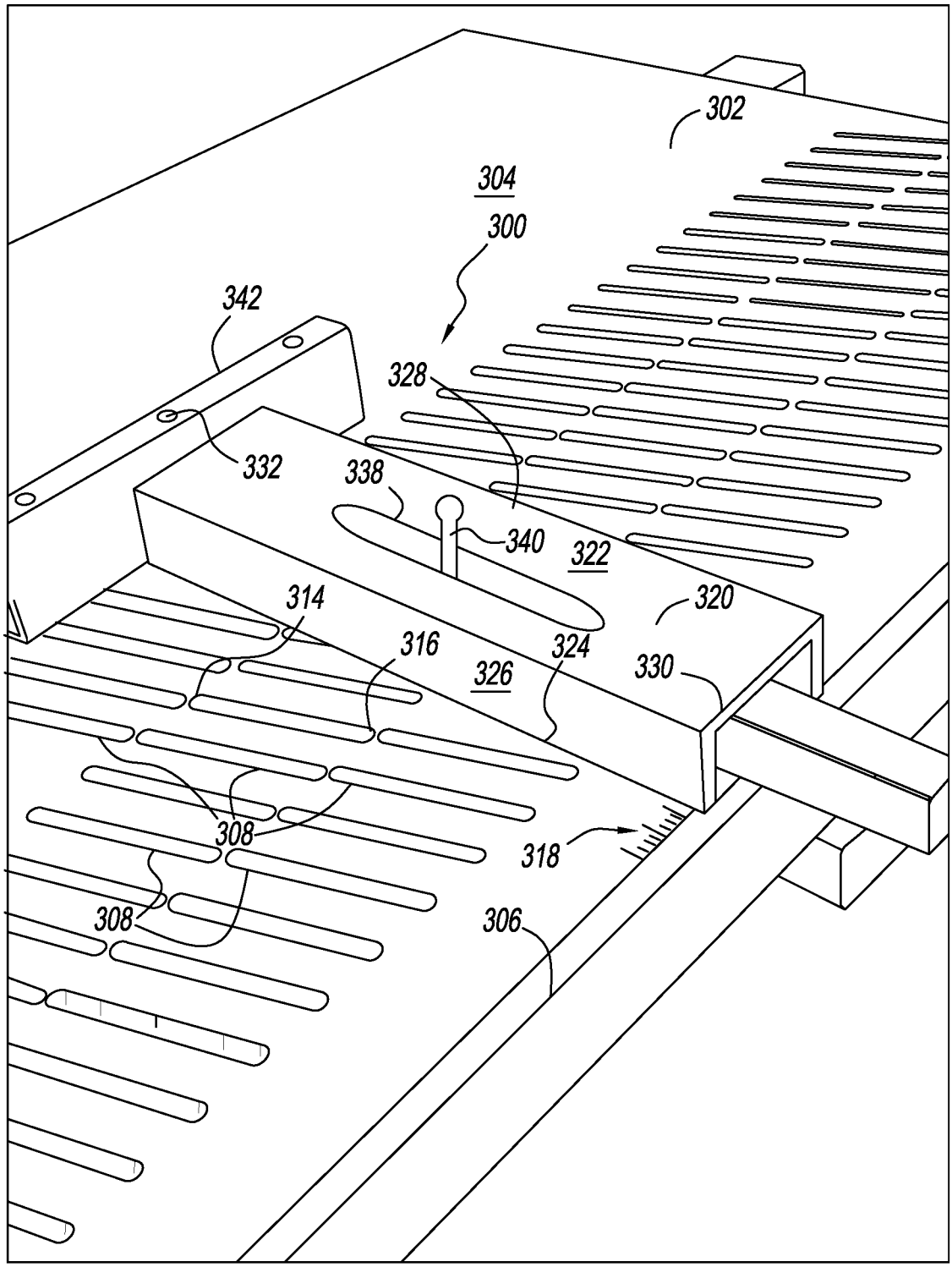
FIG. 16 is a perspective view of an adjustable stop and work table.
Figure 17:
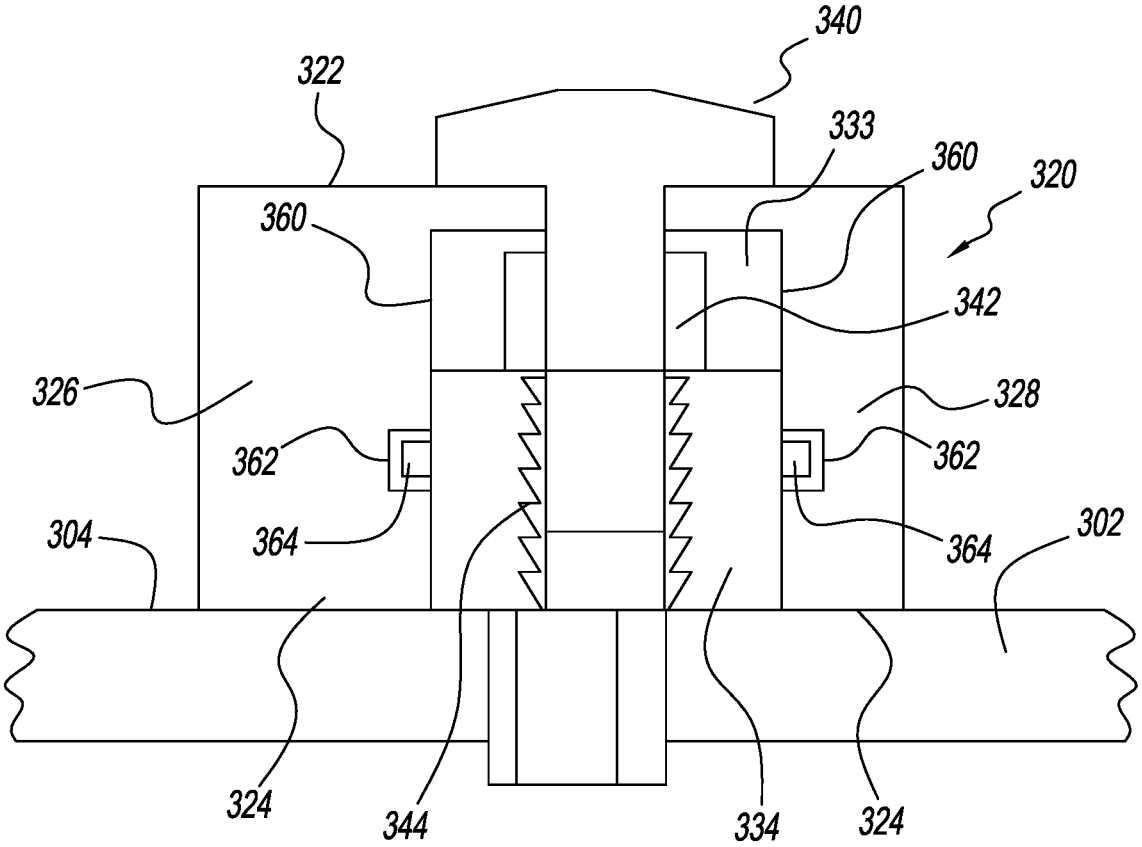
FIG. 17 is a side sectional view of an adjustable stop.
Figure 18:
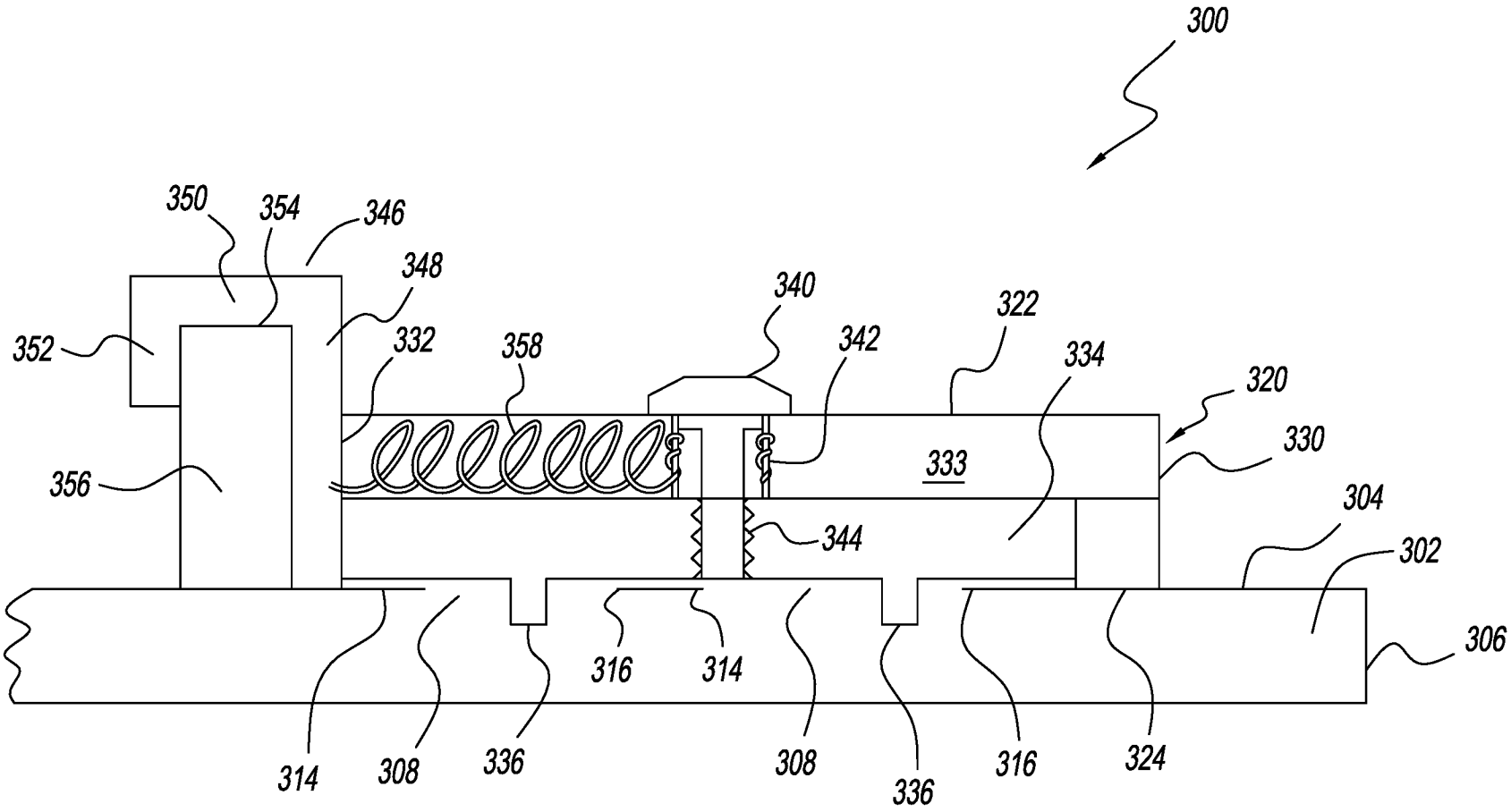
FIG. 18 is an end view of an adjustable stop.
Figure 19:
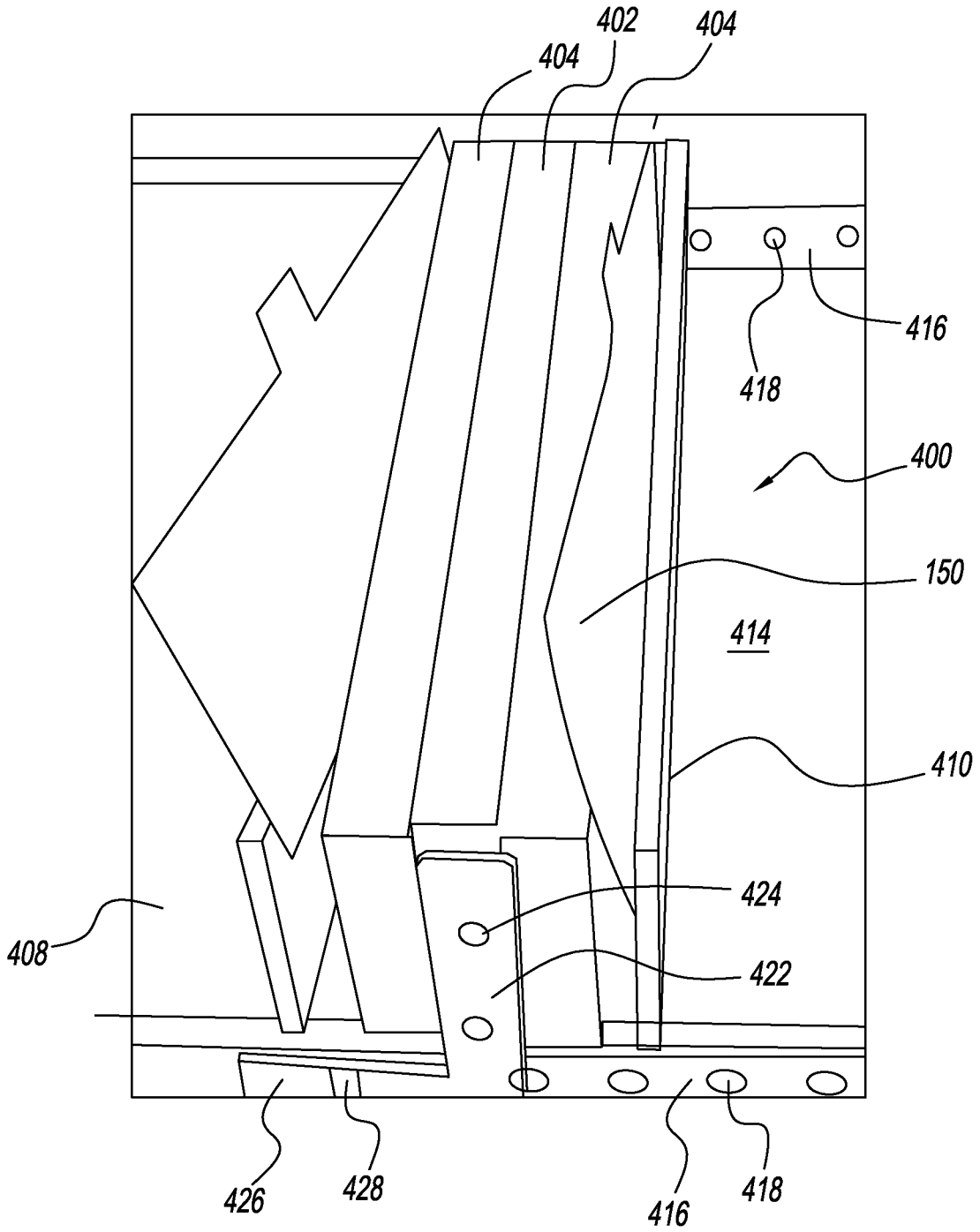
FIG. 19 is a perspective view of an adjustable stop.
Figure 20:
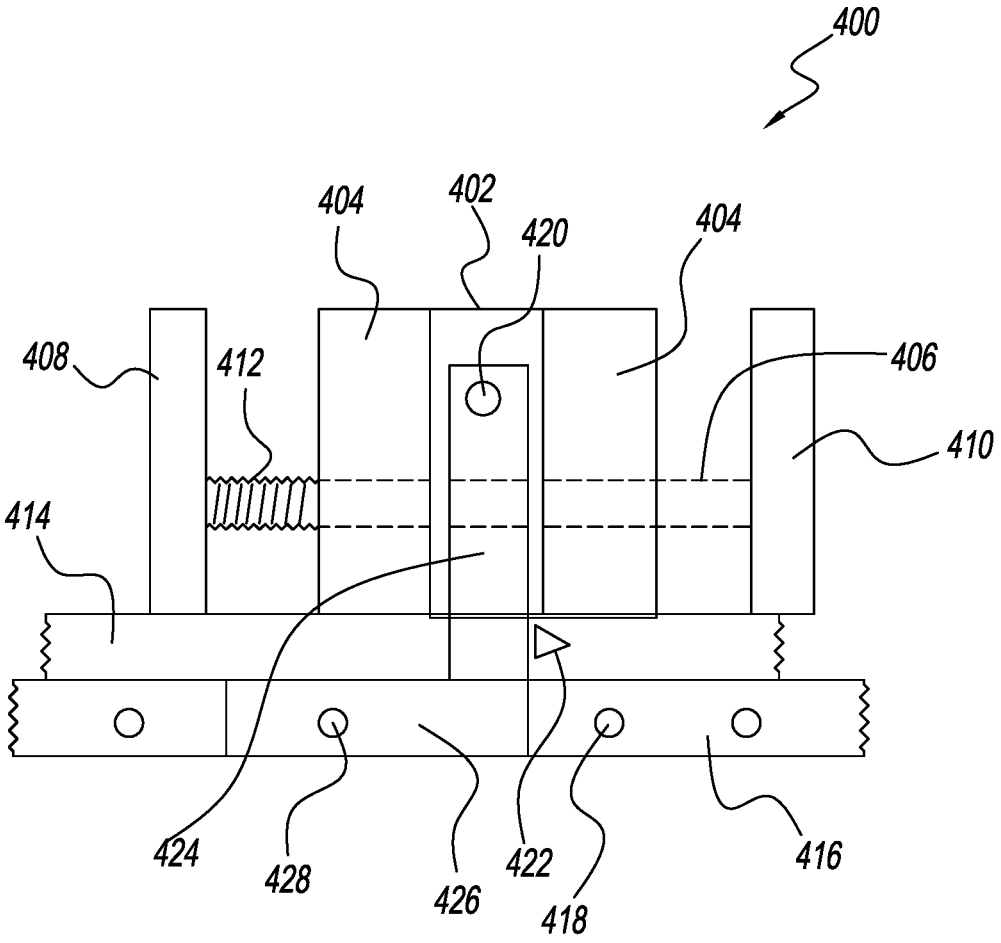
FIG. 20 is a side sectional view of an adjustable stop.

Referring to the Figures, an adjustable stop 10 is used in relation to a work table 12. The work table 12 has a top 14 and a plurality of sides 16. Aligned adjacent at least one side 16 of the top 14 are a plurality of bores 18 that are uniformly spaced. On at least one side 16, in alignment with bores 18, are a plurality of aligned and uniformly spaced bores 20.

The adjustable stop 10 has a first 22 and a second 24 housing section. The first housing section 22 has a top wall 26, a first end wall 28, a second end wall 30, a side wall 32 and a bottom wall 34. Extending downwardly from the bottom wall 34 is at least one peg 36 that forms a first lock. The peg 36 is positioned and configured to be selectively received within bores 18 on the top 14 of the table 12.

Attached to the second end wall 34 of the first housing section 22 of the adjustable stop 10 is a second lock 38. The second lock 38 is of any size, shape, and structure. In one example, the second lock 38 has an elongated plate 40 that is pivotally connected at a first end 42 to the second end wall 30. The elongated plate 40 has a length that extends beyond the bottom wall 34 of the first housing section 22. The elongated plate 40 terminates in a transverse bar 44 at the second end 46 of the plate 40. The transverse bar 44 has at least one and preferably three pegs 48 that are positioned to align with and be selectively received within bores 20 on the side 16 of the work table. A spring loaded piston 50 is connected to the elongated plate 40 and extends through second end wall 30 to hold the plate 40 against the end wall 30 in a normal closed position.

The top wall 26 of the first housing section 22 has an elongated slot 52. Adjacent the slot 52 are a plurality of markings or indicia 54 which are representative of incremental measurements. Extending through the slot 52 is a lever 56. The lever 56 is connected to a rocker bar 58 having a plurality of angled slots 60. Each angled slot 60 has a different depth in relation to a back edge 62 of the rocker bar 58.

The second housing section 24 has a top wall 64, end walls 66 and a side wall 68. Extending inwardly from the side wall 68 is one or more spring loaded stops 70. The stops 70 are of any size, shape, or structure. In one example, the stops have a shaft 72 that extends inwardly from side wall 68. A spring 74 is mounted about the shaft 72. Slidably connected to the shaft 72 is a stop block 76.

In operation, the adjustable stop 10 is positioned on the work table 12 in a desired location by inserting peg 36 into a selected bore 18. When lever 56 is positioned within the slot 52 closest to the second end wall 30, the rocker bar 58 engages the spring loaded piston 50 forcing the second lock 38 outwardly away from second end wall 30. To lock the second lock 38 the lever 56 is moved away from the second end wall 30 the spring loaded piston draws the second lock toward end wall 30 such that pegs 48 are received within bores 20.

To further adjust the stop 10 the lever 56 is moved toward the first end wall 28. As the lever 56 is moved, the rocker bar 58 is also moved toward the first end wall 28. As the rocker bar 58 moves, the spring load stop(s) 70 rock out of the angled slots 60 which gradually and incrementally move the second housing section 24 away from the first housing section 22. The depth of the slots 60 coincide with the markings 54 so that incremental adjustments can be made.

In an alternative embodiment, an adjustable device 110 for cutting an object has a frame 112 that includes a back member 114 that extends between a pair of feet 116. The object is of any type of material including wood, metal and the like. The feet 116 are formed from a hollow tube 118 having a top surface 120, and a bottom surface 122. Extending along the top surface 120 is at least one slot 123 and extending along the bottom surface 122 is at least one and preferably two slots 124. Disposed within the hollow tube 118, is an elongated insert 125. The elongated insert 125 has a top surface 126, a bottom surface 127, a first end 128, and a second end 129. Connected to and extending downwardly from the bottom surface 127 of the insert 125 is at least one and preferably two studs 137 that are aligned with and extend through slots 124. A clamping member 129A has a knob 130, a threaded shaft 131 extending outwardly and perpendicularly from the knob 130, and a threaded nut 133 that receives the threaded shaft 131.

To position the frame 112 of the wood cutting device 110, the studs 128 of the insert 125 extend through slots 124 and are selectively received within holes 132 in perforated tubing 134 connected to an outer edge of a work bench 136. Preferably the holes 132 are one inch apart and slots 124 are ½ inch apart. The clamping member 129A is then inserted through slot 123 so that an outer end 135 of the treaded shaft 131 engages the top surface of the insert 125. The frame 112 is then slid forward or backward in relation to the insert 125 to adjust the distance the frame 112 is from the blade of the saw (not shown). The nut 133 is then rotated about the threaded shaft 131 until the nut engages the top surface 120 of the feet 116. Finally the knob 130 is rotated causing the threaded shaft 131 in relation to the nut 133, to exert a downward clamping force upon the insert 125.

In an alternative embodiment, the insert 125 has an adjustment assembly 139. The adjustment assembly 139 has a threaded rod 141 that extends through a threaded longitudinally extending bore 143 in the insert 125. A first end 145 of rod 141 extends through a wall of the back member 114 and is anchored to the back member with a nut 133. At a second or opposite end 147 the rod 141 has a turning knob 130. To adjust the distance the frame 112 is from the blade of the saw, the knob 130 is turned causing the rod 141 to turn. As the rod 141 is turned the frame is drawn forward or backward in relation to the insert 125 which remains stationary.

A spring biasing member 138 is connected to the frame 112. The spring biasing member 138 has a back plate or rod 140 with a pair of side rods 142 that extend transversely away from the back plate 140. The side rods 142 extend through the back member 114 of the frame 112 and are connected to a front member 144. Fitted about the side rods 142 between the back plate 140 and the back member 114 are a pair of compression springs 146. In a normal position the front member 144 and back member 114 engage one another.

Attached to the back member 114 and extending outwardly toward the back plate 140 is a handle 148. As will be explained, use of the handle 148 with the spring compression member 138 permits one or more spacers 150 to be inserted between the front member 144 and the back member 114. The spacers 150 have a top edge 152 and a bottom edge 154. A pair of slots 156, positioned to receive the side rods 142 extend upwardly from the bottom edge 154. Preferably, spacers are provided in a first set and a second set. The first set includes three spacers 150 that are ¼ inch thick. The second set includes four spacers 150 that are 1/16 inch thick and preferably made of aluminum to add strength. In this way, all dimensions to 1/16 of an inch can be set for the device 110.

In an alternative embodiment, the spring biasing member 138 has a cross member 158 that extends between side rods 142. Attached to the cross member 158 and extending toward the back member 114 is a transverse member 160 made of a hollow tube. Connected to the back member 114 and positioned to align with and be slidably received within the transverse member 160, is a biasing member 162. Disposed about the biasing member 162 is a compression spring 146 that engages the back member 114 at one end and a compression plate 164 disposed within the transverse member 160 at an opposite end. The handle 148 is mounted to and extends outwardly from the cross member 158.

In operation, the device 110 is positioned on the work bench 136 as previously described. The distance is adjustable up to a ½ inch by inserting the studs 128 through slots 124 and into holes 132, moving the device to the desired distance, and then tightening the nut 133 on the screw 131 to engage the top surface 120 of the feet.

To adjust the face of the front member 144 by ¼ inch and/or 1/16 inch from the table saw and blade, spacers 150 are removed from between the front member 144 and the back member 114. To remove the spacers 150 the handle 148 is pulled backwardly by squeezing the handle 148 and the back plate 140 together. When squeezed, the handle 148 causes the back member 114 to move toward the back plate 140, which compresses the springs 146 and creates separation between the front member 144 and the back member 114. The spacers 150 are then removed from between the front member 144 and the back plate 114. Once removed, the handle 148 is released and the springs 146 apply pressure to the back member 114 causing the back member 114 to move toward the front member 144 securing the spacer 150 there between. At this point a piece of wood is placed on the work bench with an end engaging the front member 144, and the piece of wood is cut to the desired length.

In another embodiment the adjustable device 110 is used with a portable table assembly for cutting wood 210 or the like which includes a conventional table saw assembly 212 that could be used with other cutting devices as well. The table saw assembly 212 has a housing 214 with a blade 216 that extends partially through a top wall 218 of the housing 214, a blade lift lock 220 and handle 222 that extends through an arcuate slot 224 in a side wall 226 of the housing 214 and a left tilt lock 228 and handle 230 that extends through side wall 232 of the housing 214. The housing 214 is mounted to a base frame 234.

Pivotally mounted along a horizontal axis to the base frame 234 is a first support member 236. The first support member 236 has a cross bar 238 that terminates into a pair of legs 240 that extend downwardly to engage a ground surface. Opposite the first support member 236 and adjacent the top wall 218 of the table saw assembly 212 is a second support member 242. The second support member 242 has a cross bar 244 that terminates in a pair of legs 246 that extends downwardly to engage the ground. The second support member 242 is pivotally connected to a support post 243 along a vertical axis.

The second support member 242 is selectively connected to an elongated table 248. The elongated table 248 has a top surface 250, a bottom surface 252, a first end 254, a second end 256, and sides 258. The sides 258 preferably are made of perforated tubing. The first end 254 has a cutout section configured to receive and be connected to a portion of the table saw assembly 212. Preferably, the top wall 218 of the table saw assembly 212 is flush with and dwells in the same plane as the top surface 250 of the elongated table 248 within the cutout section 255. The second support member 242 has a locking bracket or pin 260 that locks the table 248 in a vertical transport position.

Adjacent the second end 256 of the elongated table 248, and pivotally connected to the bottom surface 252 of the table 248, is a third support member 262. The third support member 262 has a cross bar 264 that terminates in a pair of legs 266 that extend downwardly to engage the ground. In a transport position, the third support member 262 is parallel the bottom surface 252 of the table 248 and fits between the perforated tubes 258 or sides.

The assembly 210 is transported using a conventional dolly 268 or the like that fits underneath the table saw assembly 212. To move the assembly 210 from a transport position to an operating position the bracket or pin 260 is removed from the side tubing 258 and the second support member 242 is pivoted along the vertical axis away from the elongated table 248. Once out of the way, the elongated table 248 and the table saw assembly 212 are pivoted along the horizontal axis from a vertical to a horizontal position. The third support member 262 is pivoted away from the bottom surface 252 of the table 248 to a transverse position in relation to the table to support the second end 256 of the table 248. The second support member 242 is pivoted back toward and underneath the table 242 to support the first end 254 of the table 248.

Additionally, or alternatively, a second portable table assembly 270 is used separately or is connected to the first table assembly 210. The second table assembly 270 has a conventional radial arm saw 272 mounted to a first table section 274. The first table section 274 is mounted to a cabinet 276 and supported by legs 278.

Pivotally connected to the first table section 274 is a second table section 280 that extends downwardly and transversely to the first table section 274 in a transport position. The second table section 280, at an opposite end, is pivotally connected to a third table section 282. The third table section 282 is vertically parallel to the second table section 280 in the transport position.

The third table section 282 has a first end 284, connected to the second table section 280, a second end 286 and sides 288 preferably made of perforated tubing. Pivotally connected to the first end 284 of the third table section 282 is a fourth support member 290. The fourth support member 290 has a cross bar 292, legs 294 having wheels 296 at one end, and braces 298 that extend between the legs 294 and intersect. The second table assembly 270 is transported like the first table assembly 210 using a conventional dolly 268 that fits underneath the cabinet 276.

To move the second table assembly 270 from a transport to an operating position the third table section 282 is pivoted away from the second table section 280 and the second table section 280 is pivoted away from the cabinet 276 until the second table section 280 and the third table section 282 dwell in the same horizontal plane as the first table section 274. The fourth support member 290 is then pivoted away from the third table section 282 until the legs 294 or the wheels 296 engage the ground surface.

If desired the second end 286 of the third table section 282 of the second table assembly 270 can be positioned to abut and connect to the second end 256 of the elongated table 248 of the first table assembly 210.

Adjustably attached to the top surface of the table 248, second section 280, and/or third section 282 is a fence or adjustable stop 10 or 110 for cutting wood or the like. To assist in adjusting the stop 10 or 110 laterally, on one side 232 of the table 248 and sections 280 and 282, the perforated tubing has elongated slots 306. Alternatively, the table 248 and sections 280 and 282 are made of a single piece where the table sides 258 are bent downwardly to form a C-shape and slots 306 are formed on one side and holes 308 are formed on the opposite side.

In another embodiment, an adjustable stop 300 is selectably attached to a work table 302. The work table 302 has a work surface 304 and a side edge 306. Extending through the work table 302 are a plurality of slots 308. Preferably the slots 308 are aligned in rows 310 and columns 312 and are positioned at an angle in relation to the side edge 306. The rows are preferably spaced 2 inches apart.

Each slot 308 has a first end 314 and a second end 316. The slots are preferably extend three inches in length on the horizontal and two inches on the vertical producing an angled length of approximately 3.6 inches. The first 314 and second end 316 are spaced 2 inches in relation to the ends 314,316 in adjacent slots 308 in the same column. Indicia 318 is marked along the side edge 306, on the work surface 304, and/or on the adjustable stop 300 at 1/16 inch increments.

The adjustable stop 300 has a housing 320 having a top 322, a bottom 324, a first side 326, a second side 328, a first end 330, and a second end 332 that form an inner slot 333. A locking bar 334 slidably extends through the inner slot of the housing 320 from the first end 330 to the second end 332.

The locking bar 334 has a plurality of bolts or studs 336 that extend from the locking bar 334 and through the open bottom 324 of the housing 320 into the slots 308. Preferably the locking bar 334 is seven inches long and the studs 336 are spaced six inches apart and an equal distance from the center of the locking bar 334.

A slot 338 extends along the top 322 of the housing 320 and receives a locking screw 340. Preferably the slot 338, is three inches long. The locking screw 340 extends through a spacer 342 positioned in the inner slot 333 of the housing 320 and into a threaded bore 344 positioned at the center of the locking bar 334.

Attached to the second end 332 of the housing 320 is a hook 346 that has a first vertical wall 348 that terminates in a horizontal wall 350, which terminates in a second vertical wall 352, that is in spaced parallel relation to the first vertical wall 348 to form a slot 354. The hook is positioned and adapted to receive a fence 356, that is attached to and extends the full length of the work surface 304, within slot 354. A spring 358 is positioned within the inner slot 333 of the housing 320 between the first vertical wall 348 of the hook 346 and the spacer 342.

An inner surface 360 of both the first side 326 and the second side 328 of the housing 320 have a slot 362 that extends the length of the housing 320. A roll pin 364 or the like is received in the slot 362 and assists in sliding and stabilizing the locking bar 334 within the inner slot 333 of the housing 320.

In operation, based upon the desired length of the board to be cut, the stop 300 is connected to the work table 302 by inserting the studs 336 of the locking bar 334 into slots 308 and placing the hook 346 over the fence 356 at the desired length marked on the indicia 318. The spring 358, in its normal state, biases the studs 336 of the locking bar 334 to the second end 316 of the slots 308. The locking screw 340 is then manually moved within the slot 338 on the top 322 of the housing 320 which causes the spacer 342 and locking bar 334 to slide within the inner slot 333 of the housing 320 compressing the spring 358. When the desired length for the cutting of an object is reached, the locking screw 340 is manually rotated into the threaded bore 344 of the locking bar 344 to provide a clamping force to lock the stop 300 in the desired position.

In another embodiment an adjustable device 400 for cutting an object has a central elongated member 402 positioned between two elongated support members 404. The central member 402 preferably is made of metal and the side members 404 are made of a hard plastic.

Slidably extending transversely through members 402 and 404 are parallel spaced rods 406. The rods 406 are connected to a back plate 408 at one end and a front member 410 at the opposite end. A spring 412 is positioned about each rod 406 between the back plate 408 and a support member 404 which biases the back plate 408 away from the side member 404 and biases the front member 410 toward the other side member 404.

The adjustable member 400 is placed on a work surface 414 so that a bottom surface of members 402 and 404 engage the work surface 414. Attached to the top of the work surface 414 on one side is tubing 416 having a plurality of evenly spaced holes 418 preferably one inch apart. Attached to the bottom of the work surface 414 on the opposite side of the work surface 414 is another tube 416 with holes 418 positioned so that the holes 418 of the two tubes 416 align.

A positioning rod 420 extends through the length of the central member 402. One end of the positioning rod is attached to a bracket 422. The bracket is of any size, shape, and structure. In one example, the bracket 422 is L-shaped with a vertical section 424 and a horizontal section 426. The vertical section 424 aligns with the end of the central member 402 and extends below the work surface 414. The horizontal section 426 aligns with tube 416 and has a hole 428 that is adapted to selectively align with the holes 418 in the tube 416. The opposite end of positioning rod 420 extends beyond the central member 402 and is adapted to be selectively received within a hole 418 of the tube 416 on top of the work surface 414.

In operation, the adjustable stop 400 is placed on the work surface 414 and the positioning rod 420 is inserted into a hole 418 in the tube 416 on top of the work surface 414. The hole 428 in the bracket 422 at the opposite end of the adjustable stop 400 is aligned with the corresponding hole 418 in the tube 416 on the bottom of the work surface. To further adjust the distance between the front member 410 and the cutting line of the saw (not shown), spacers 150, as previously described, are inserted between the front member 410 and the side support member 404 by using manual force to compress springs 412. Through use of the spacers 150 the distance can be adjusted in $1/16^{th}$ inch increments.

In yet another embodiment an adjustable stop 500 includes a block 502 having a top 504, bottom 506, front 508, back 510, first end 512, and second end 514. Disposed within the block 502 is a magnet 516. The spacers 150 are made of a material that is attracted to the magnet 516 and preferable one spacer is ¼ inch thick and three spacers are 1/16 inch thick. The block is attached to the work surface 414 as previously described using a rod 420 extending from the first end 512 and a bracket 422 at the second end 514.

From the above discussion and accompanying figures and claims it will be appreciated that the adjustable stop 10 offers many advantages over the prior art. It will be appreciated further by those skilled in the art that other various modifications could be made to the device without parting from the spirit and scope of this invention. All such modifications and changes fall within the scope of the claims and are intended to be covered thereby. It should be understood that the examples and embodiments described herein are for illustrative purposes only and that various modifications or changes in the light thereof will be suggested to persons skilled in the art and are to be included in the spirit and purview of this application.

What is claimed is:

1. An adjustable stop for cutting an object, comprising:
- a central member;
- a back plate and a front member slidably connected to the central member by a pair of spring biased rods; and
- a plurality of spacers adapted to be selectively positioned between the front member and the central member, wherein the plurality of spacers have a pair of slots that extend upwardly from a bottom edge.

2. The adjustable stop of claim 1 wherein the central member is positioned between a pair of side support members.

3. The adjustable stop of claim 1 further comprising the central member positioned between a first support member and a second support member, wherein the first support member is positioned between the back plate and the central member and the second support member is positioned between the central member and the front member.

4. The adjustable stop of claim 3 further comprising a bottom surface of the first support member and the second support member engaging a work surface.

5. The adjustable stop of claim 4 further comprising a first tubing attached to a top surface of the work surface, wherein the first tubing has a plurality of spaced holes, and a second tubing attached to a bottom surface of the work surface, wherein the second tubing has a plurality of spaced holes.

6. The adjustable stop of claim 4 wherein the plurality of holes of the first tubing align with the plurality of holes of the second tubing.

7. The adjustable stop of claim 1 further comprising a positioning rod extending through a length of the central member, wherein the pair of spring biased rods extend transversely though the central member.

8. The adjustable stop of claim 7 further comprising a bracket attached to one end of the positioning rod.

9. The adjustable stop of claim 8 wherein the bracket has an L-shape formed by a vertical section and a horizontal section.

10. The adjustable stop of claim 9 wherein the vertical section aligns with an end of the central member and extends below a work surface.

11. The adjustable stop of claim 10 wherein the horizontal section aligns with a first tubing attached to the work surface.

12. The adjustable stop of claim 1 wherein the pair of slots are configured to receive the pair of spring biased rods.

13. An adjustable stop for cutting an object, comprising:

a central member positioned between a first support member and a second support member;

a back plate positioned such that the first support member is between the back plate and the central member;

a front member positioned such that the second support member is between the front member and the central member;

a plurality of parallel spaced rods extending transversely through the first support member and the second support member, wherein the plurality of parallel spaced rods are connected to the back plate at one end and the front member at another end; and a spring positioned about at least one of the plurality of parallel spaced rods, wherein the spring is positioned between the back plate and the first support member and biases the first support member away from the back plate and towards the front member.

14. The adjustable stop of claim 13 further comprising a bottom surface of the first support member and the second support member engaging a work surface; a first tubing attached to a top surface of the work surface, wherein the first tubing has a plurality of spaced holes; and a second tubing attached to a bottom surface of the work surface, wherein the second tubing has a plurality of spaced holes.

15. The adjustable stop of claim 14 further comprising a positioning rod extending through a length of the central member, wherein the positioning rod is received in one of the plurality of spaced holes in the first tubing.

16. The adjustable stop of claim 15 further comprising a bracket attached to one end of the positioning rod, wherein the bracket has a hole that aligns with one of the plurality of spaced holes in the second tubing.

17. The adjustable stop of claim 14 wherein the plurality of holes of the first tubing are evenly spaced and align with the plurality of holes in the second tubing that are evenly spaced.

18. The adjustable stop of claim 13 further comprising a positioning rod extending through a length of the central member; a bracket attached to one end of the positioning rod, wherein the bracket has an L-shape formed by a vertical section and a horizontal section.

19. The adjustable stop of claim 18 wherein the vertical section aligns with an end of the central member and extends below a work surface; and the horizontal section aligns with a first tubing attached to the work surface such that a hole in the horizontal section selectively aligns with one of a plurality of spaced holes of the first tubing.

20. The adjustable stop of claim 13 further comprising a spacer having a slot to receive one of the plurality of parallel spaced rods.

* * * * *